US009392389B2

(12) United States Patent
Hall et al.

(10) Patent No.: US 9,392,389 B2
(45) Date of Patent: Jul. 12, 2016

(54) DIRECTIONAL AUDIO NOTIFICATION

(71) Applicant: MICROSOFT TECHNOLOGY LICENSING, LLC, Redmond, WA (US)

(72) Inventors: Michael Anthony Hall, Bellevue, WA (US); Joshua O. Miller, Woodinville, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 14/318,439

(22) Filed: Jun. 27, 2014

(65) Prior Publication Data

US 2015/0382124 A1 Dec. 31, 2015

(51) Int. Cl.
*H04S 1/00* (2006.01)
*H04S 7/00* (2006.01)

(52) U.S. Cl.
CPC ..... *H04S 1/007* (2013.01); *H04S 1/002* (2013.01); *H04S 7/303* (2013.01); *H04R 2201/40* (2013.01); *H04R 2203/12* (2013.01); *H04R 2217/03* (2013.01)

(58) Field of Classification Search
CPC ..... H04R 5/02; H04R 5/04; H04R 3/12; H04R 2499/15; H04R 2205/022; H04R 2420/07; H04R 2420/03
USPC ..... 381/300
See application file for complete search history.

(56) References Cited

U.S. PATENT DOCUMENTS 5,533,129 A * 7/1996 Gefvert ..... H04R 5/02 381/18
7,783,059 B2 * 8/2010 Yamasaki ..... G11B 31/003 369/2
8,208,970 B2 6/2012 Cheung et al.
8,311,249 B2 * 11/2012 Koyama ..... H04R 5/04 381/300

(Continued)

FOREIGN PATENT DOCUMENTS

WO 2012160459 A1 11/2012

OTHER PUBLICATIONS

Rasbury, Michael, "Audio Spotlight Sound System Research Report", Retrieved on: Mar. 12, 2014, Available at: http://people.virginia.edu/~mr2xk/researchexamples/2005-2006/audiospotlight.pdf.

(Continued)

*Primary Examiner* — Mark Blouin
(74) *Attorney, Agent, or Firm* — Gregg Wisdom; Judy Yee; Micky Minhas

(57) ABSTRACT

Various embodiments related to providing an audio notification to a listener via a dual-mode speaker system are provided. In one embodiment, a computing device and associated dual-mode speaker system are configured to be selectively operable in a non-directional broadcast mode and a directional broadcast mode. Based on an audio notification condition, it is determined that the audio notification is to be delivered using the directional broadcast mode. The dual-mode speaker system is then used to broadcast the audio notification to the listener using the directional broadcast mode.

23 Claims, 5 Drawing Sheets

(56) References Cited

U.S. PATENT DOCUMENTS

| | | | | |
|---|---|---|---|---|
| 8,452,020 | B2 | 5/2013 | Gregg et al. | |
| 2004/0208324 | A1 | 10/2004 | Cheung et al. | |
| 2008/0049964 | A1 | 2/2008 | Porwal et al. | |
| 2010/0158287 | A1* | 6/2010 | Xu | H04R 1/028 381/300 |
| 2010/0303265 | A1 | 12/2010 | Porwal | |
| 2012/0038827 | A1 | 2/2012 | Davis | |
| 2012/0120218 | A1 | 5/2012 | Flaks et al. | |
| 2013/0041648 | A1 | 2/2013 | Osman | |
| 2013/0272096 | A1 | 10/2013 | Pandharipande et al. | |
| 2013/0321625 | A1 | 12/2013 | Yanagihara et al. | |

OTHER PUBLICATIONS

Kuutti, et al., "Local Control of Audio Environment: A Review of Methods and Applications", In Proceedings of Technologies, vol. 2, Issue 1, Feb. 10, 2014, 23 pages.

"Wired PC Surround Sound", Retrieved on: Mar. 20, 2014, Available at: http://www.turtlebeach.com/product-detail/headsets-legacy/ear-force-z6a/44.

"Parametric Sound", Retrieved on: Mar. 20, 2014, Available at: http://parametricsound.com/.

ISA European Patent Office, International Search Report and Written Opinion issued in Application No. PCT/US2015/037311, Nov. 10, 2015, WIPO, 9 pages.

* cited by examiner

DIRECTIONAL AUDIO NOTIFICATION

BACKGROUND

Users of computing devices may receive alerts, reminders, and other notifications via the devices. For example, a gamer may receive visual and/or audio achievement notifications during a gaming session. Smart phone users may receive visual and/or audio reminders of an upcoming appointment. Emails or text messages may be vocalized via a device speaker. Numerous other examples of audio and/or visual alerts are commonly provided by various computing devices.

However, receiving such alerts may interfere with a device user's current experience. For example, a visual alert displayed on a device screen may obscure a portion of the user's visual experience. If one or more other persons are nearby the user, such audio and/or visual alerts may also prove annoying to those persons. Additionally, and to the dismay of the device user, such alerts may communicate to others personal information intended solely for the device user. With the increasing proliferation of computing devices, these potential drawbacks with such alerts are becoming increasingly problematic.

SUMMARY

Various examples are disclosed herein that relate to providing an audio notification to a listener via a dual-mode speaker system of a computing device. In one example method, a computing device and associated dual-mode speaker system are configured to be selectively operable in a non-directional broadcast mode and in a directional broadcast mode. An audio notification condition is identified and, based on the audio notification condition, the method determines that the audio notification is to be delivered using the directional broadcast mode. The audio notification is then broadcast to the listener via the dual-mode speaker system using the directional broadcast mode.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
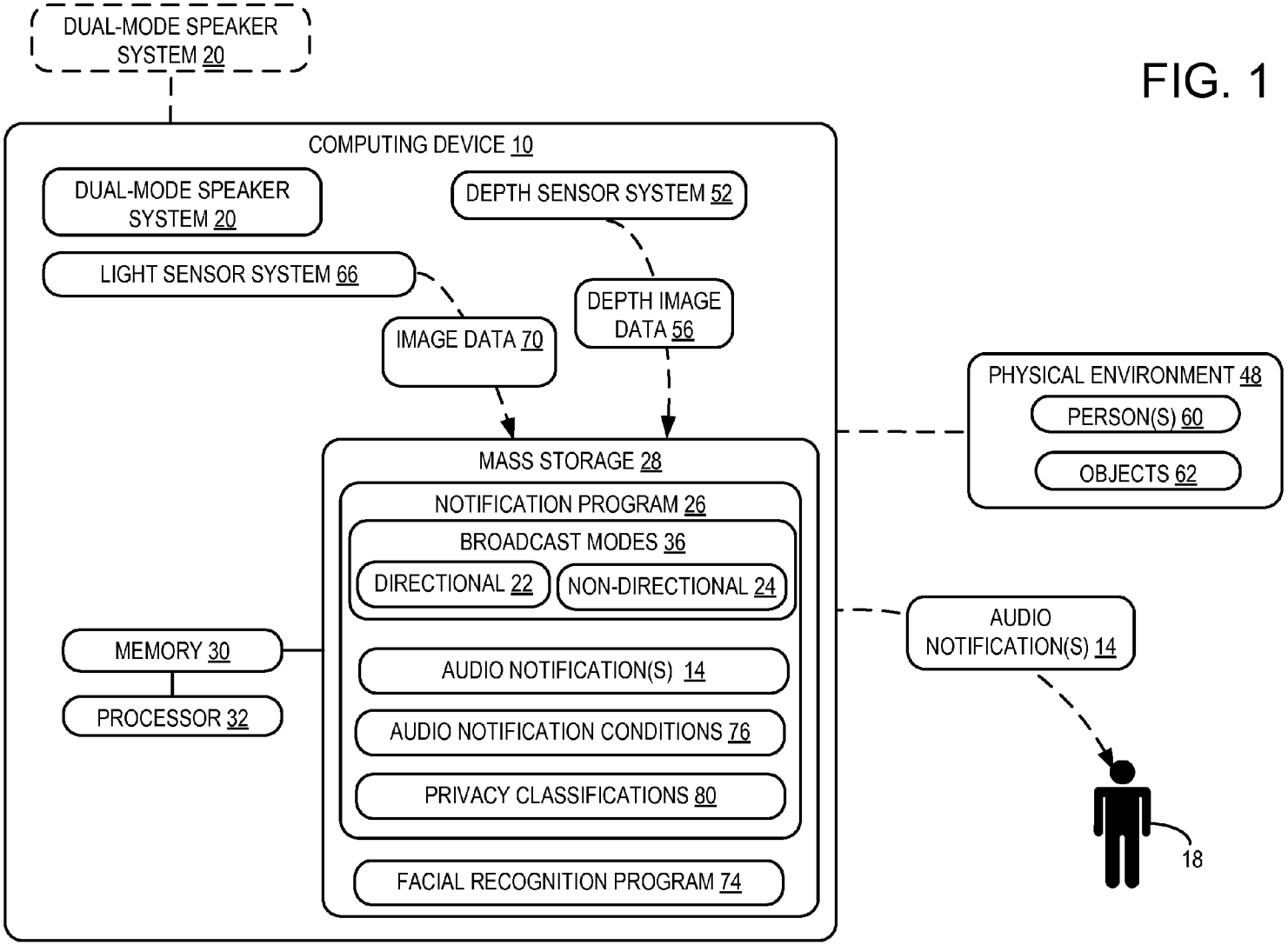
FIG. 1 shows a computing device and dual-mode speaker system for providing an audio notification according to an embodiment of the present disclosure.

FIG. 1 shows a schematic view of one embodiment of computing device 10 for providing audio notifications 14 to a listener 18 via a dual-mode speaker system 20. As described in more detail below, the dual-mode speaker system 20 may broadcast audio notifications 14 in a directional broadcast mode 22 or in a non-directional broadcast mode 24. The computing device 10 includes a notification program 26 that may be stored in mass storage 28 of the computing device 10. The notification program 26 may be loaded into memory 30 and executed by a processor 32 of the computing device 10 to perform one or more of the methods and processes described in more detail below.

The notification program 26 may include a plurality of broadcast modes 36 comprising a directional broadcast mode 22 and a non-directional broadcast mode 24. Advantageously and described in more detail below, the broadcast modes 36 may be selectively engaged to provide audio notifications 14 that are tailored to a user's particular needs and/or to environments or surroundings having particular characteristics, and are broadcast in a context-appropriate manner via the dual-mode speaker system 20.

It will be appreciated that various types and form factors of computing devices may provide audio notifications 14 to a user via dual-mode speaker systems 20 comprising one or more speakers that share a common enclosure with the computing device. In other examples, dual-mode speaker systems 20 may comprise one or more speakers that are communicatively coupled to a computing device 10 and are physically separated from the device.

As described in more detail below, in some instances it may be desirable to broadcast an audio notification in a directional broadcast mode 22. For purposes of this disclosure, a directional broadcast mode 22 refers to broadcasting audio in a focused manner such that sound waves are beamed to a selected person and/or location. In one example, a directional broadcast mode 22 may utilize a directional speaker that generates sound waves along a highly directional ultrasonic column that may be directed to a particular location. It will also be appreciated that any suitable directional audio technology may be utilized to broadcast audio in such a directional manner.

In other instances, it may be acceptable or desirable to broadcast an audio notification in a non-directional broadcast mode 24. For purposes of this disclosure, a non-directional broadcast mode 24 refers to broadcasting audio in an unfocused manner such that the sound waves are broadly radiated from the speaker or speakers.

In various examples the computing device 10 may comprise a tablet computer, laptop computer, smartphone, wearable computing device, or other mobile computing device, set-top box, home entertainment computer, interactive television, gaming system, desktop computing device, standalone monitor, wall-mounted display, interactive whiteboard, or other like device. Additional details regarding the components and computing aspects of the computing device 10 are described in more detail below with reference to FIG. 4.

The computing device 10 may include various sensors and related systems that receive physical environment data from a physical environment 48 in which the computing device is located. In the example of FIG. 1, the computing device 10 includes a depth sensor system 52 that includes one or more depth cameras that generate depth image data 56. Depth sensor system 52 may also detect movements within its field of view, such as gesture-based inputs or other movements performed by listener 18 or by a person 60 or physical object 62 within the depth cameras' field of view. In one example, each depth camera may include left and right cameras of a stereoscopic vision system. Time-resolved images from one or more of these depth cameras may be registered to each other and/or to images from another optical sensor such as a visible spectrum camera, and may be combined to yield depth-resolved video.

In other examples, a structured light depth camera may be configured to project a structured infrared illumination, and to image the illumination reflected from a scene onto which the illumination is projected. A depth map of the scene may be constructed based on spacings between adjacent features in the various regions of an imaged scene. In still other examples, a depth camera may take the form of a time-of-flight depth camera configured to project a pulsed infrared illumination onto a scene and detect the illumination reflected from the scene. It will be appreciated that any other suitable depth camera may be used within the scope of the present disclosure.

The computing device 10 may also include a visible light or infrared light sensor system 66 that utilizes at least one outward facing sensor, such as an RGB camera, IR camera or other optical sensor. The light sensor system 66 may generate image data 70 that is provided to the notification program 26. The outward facing sensor(s) may capture two-dimensional image information from physical environment 48.

In some examples, the image data 70 may comprise images of faces of the listener 18 and/or one or more other persons 60 in the physical environment 48. Such facial images may be provided to a facial recognition program 74 of the computing device 10, which may utilize such images to identify the listener and/or the one or more other persons. It will be appreciated that any suitable facial recognition techniques, algorithms and technologies may be utilized to perform such identification, and are within the scope of the present disclosure. It will also be appreciated that many types and configurations of sensor systems and related computing devices having various form factors may also be used and are within the scope of the present disclosure.

Figure 2:
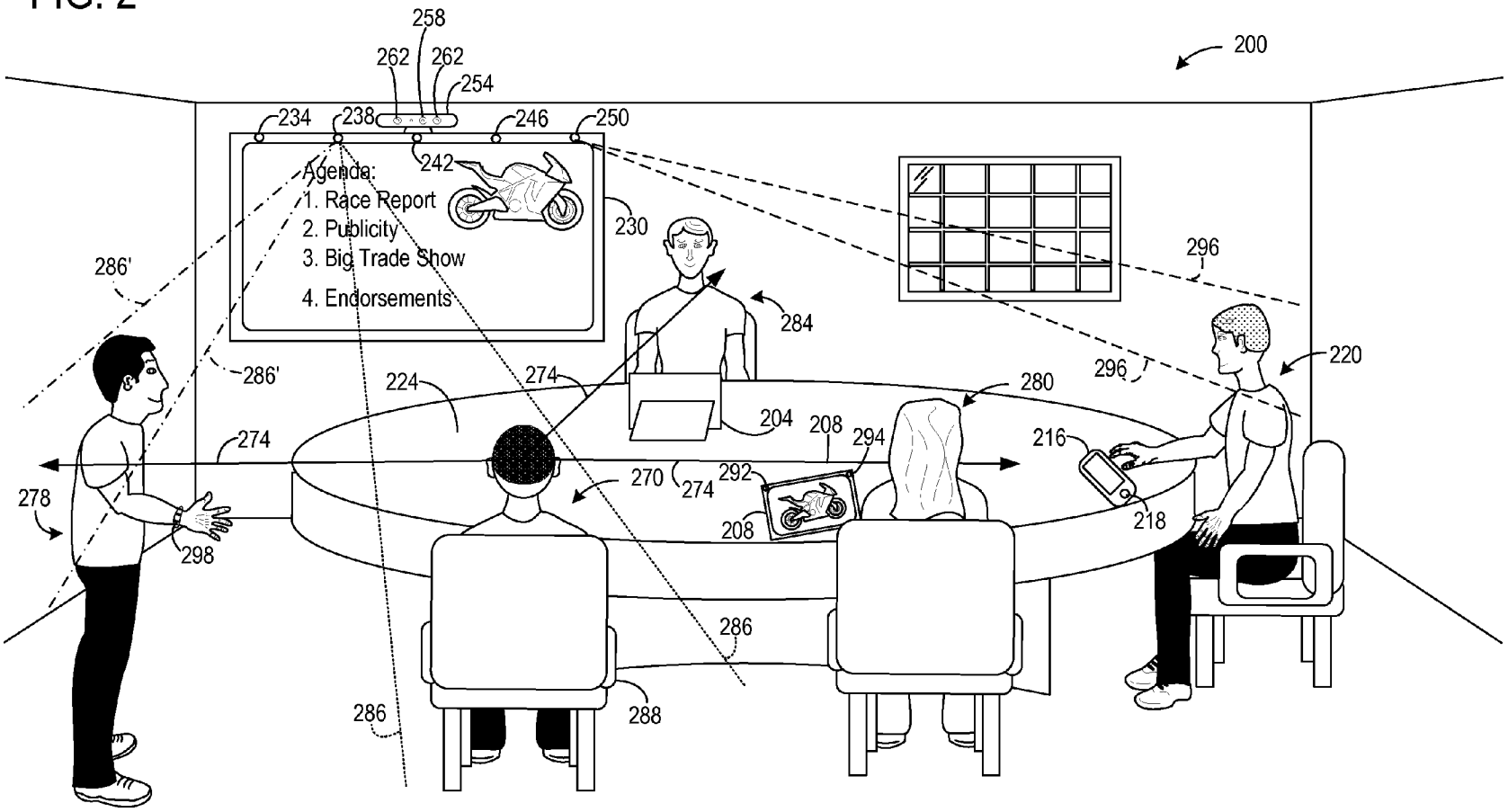
FIG. 2 shows a schematic perspective view of a room including multiple people and various computing devices for providing audio notifications according to embodiments of the present disclosure.

With reference now to FIG. 2, descriptions of example use cases of the present disclosure will now be provided. FIG. 2 schematically illustrates a conference room 200 in which several employees and/or non-employees are gathered for a meeting. Various types of computing devices 10 and associated dual-mode speaker systems 20 are located in the room 200. Such computing devices include first a tablet computer 204 and a second tablet computer 208. A mobile phone 216 used by employee Albert 220 is resting on table 224. It will be appreciated that each of these various computing devices may include the dual-mode speaker system 20 and one or more components and systems of computing device 10 described above.

Additionally, wall-mounted display 230 is also located in room 200. In this example, wall-mounted display 230 may include a dual-mode speaker system 20 comprising first speaker 234, second speaker 238, third speaker 242, fourth speaker 246 and fifth speaker 250. In other examples it will be appreciated that one, two, or any other suitable number of speakers may be utilized with the dual-mode speaker system 20 of wall-mounted display 230. The wall-mounted display 230 also may be communicatively coupled to a set-top box 254 that includes computing device 10. In this example set-top box 254 includes optical sensor 258 and depth cameras 262.

It will be appreciated that the wall-mounted display 230 and set-top box 254 are merely exemplary, and that many other configurations of computing devices and associated dual-mode speaker systems having one, two, three, or any other suitable number of speakers may be utilized and are within the scope of the present disclosure.

The computing device 10 and associated dual mode speaker system 20 of wall-mounted display 230 may be configured to be selectively operable in the directional broadcast mode 22 and the non-directional broadcast mode 24. More particularly, the notification program 26 may be configured to identify an audio notification condition 76 and, based on the condition, determine whether an audio notification is to be delivered using a directional broadcast mode 22 or a non-directional broadcast mode 24.

In one example, listener Bob 270 may utilize a calendar application that the set-top box 254 and notification program 26 may access via a network, such as the Internet. The notification program 26 may determine via the calendar application that listener Bob 270 has a medical appointment in 15 minutes, and that Bob has requested an audio reminder 15 minutes prior to the appointment. In this example, an audio notification condition 76 may comprise identifying a presence of at least one person within a predetermined proximity 274 of listener Bob 270. In the present example, the predetermined proximity 274 may be 6 foot radius from listener Bob 270. Accordingly, utilizing depth image data 56 from the depth cameras 262, the notification program 26 may identify the presence of Charlie 278, Darla 280, and Edward 284 within the predetermined proximity 274 of listener Bob 270.

It will be appreciated that in other examples, any suitable distance or other predetermined proximity from a listener may be utilized. In other examples, an audio notification condition 76 may comprise identifying a presence of at least one person within the same room as listener Bob 270.

Based on identifying the presence of at least one person within the predetermined proximity 274 of listener Bob 270, the notification program 26 determines that the audio reminder is to be delivered to listener Bob using the directional broadcast mode 22. Accordingly, the notification program 26 may broadcast the audio reminder via the dual-mode speaker system 20 of wall-mounted display 230 using the directional broadcast mode 22. In FIG. 2, sound column 286 schematically illustrates broadcasting the audio reminder to listener Bob 270 using the directional broadcast mode 22. Advantageously, in this manner solely listener Bob 270 hears the audio reminder of his medical appointment, thereby leaving the other persons in room 200 undisturbed by this notification for listener Bob.

As shown in the example of FIG. 2, speaker 238 of the wall-mounted display 230 may broadcast the audio reminder using the directional broadcast mode 22. In one example, speaker 238 may be a dual-mode speaker that is selectively operable in the directional broadcast mode 22 and the non-directional broadcast mode 24. Advantageously, in this example speaker 238 may broadcast audio notifications 14 in either mode.

In some examples, speaker 238 may be a directional speaker that is fixedly attached in an unmovable manner to the wall-mounted display 230, such that sound column 286 broadcasts audio to a fixed location within room 200. For example, speaker 238 may be fixedly oriented within wall-mounted display 230 to broadcast audio to the location at which chair 288 is currently located. In this manner, the dual-mode speaker system 20 may utilize a fixed directionality for speaker 238 to selectively provide audio to the current location of chair 288. One or more other speakers of the dual-mode speaker system also may be fixedly attached in an unmovable manner to the wall-mounted display 230 to broadcast audio to other defined locations within room 200.

In other examples, speaker 238 may be a directional speaker that is selectively moveable to broadcast audio to different locations within room 200. In this manner, the notification program 26 may move or aim speaker 238 to a desired location in the room 200 to deliver directional audio to one or more selected persons or locations. For example, the notification program may identify an urgent text message for listener Charlie 278. Using depth image data 56, the notification program may determine the listener position of listener Charlie 278 within the room 200.

Based on the listener position of listener Charlie 278, the notification program may modify a broadcast direction of an audio notification 14 of the text message to directionally deliver the notification to listener Charlie 278. As shown in FIG. 2, in one example the orientation of speaker 238 may be adjusted to move sound column 286' to an adjusted location that delivers the text message notification solely to listener Charlie 278.

In some examples, a dual mode speaker system 20 may utilize one or more directional speakers that are solely operable in the directional broadcast mode 22, and one or more non-directional speakers that are solely operable in the non-directional broadcast mode 24. For example, listener Darla 280 may be sitting with her tablet computer 208 on the table 224 in front of her. Tablet computer 208 may be equipped with a directional speaker 292 solely operable in the directional broadcast mode 22 and a non-directional speaker 294 solely operable in the non-directional broadcast mode 24.

In one example, tablet computer 208 may receive a severe weather alert warning of an approaching dangerous weather system. Based on analyzing the weather alert, the notification program 26 of tablet computer 208 may identify an emergency audio notification condition 76 that is preferably delivered broadly using the non-directional broadcast mode 24. Accordingly, the tablet computer 208 may broadcast the weather alert non-directionally via non-directional speaker 294 to enable all persons in the room 200 to hear the alert.

In other examples, the notification program 26 of tablet computer 208 may identify an audio notification condition 76 that calls for an audio notification 14 to be delivered solely to listener Darla 280 using the directional broadcast mode 22. In these examples, the tablet computer 208 may broadcast the audio notification 14 solely to listener Darla 280 via the directional speaker 292.

In another example, listener Bob 270 and listener Albert 220 may each have different appointments at 2:00 pm scheduled on their calendar applications. Both appointments may include an audio reminder 10 minutes prior to the appointment. Accordingly, at 1:50 pm the broadcast notification program 26 in set-top box 254 may directionally broadcast to listener Bob 270 a first audio reminder of his 2:00 pm appointment via directional speaker 238.

Also at 1:50 pm and as indicated by sound column 296, the broadcast notification program 26 may directionally broadcast to listener Albert 220 a second audio reminder of his 2:00 pm appointment via another directional speaker 250. Advantageously, in this manner both audio notifications may be delivered listener Bob 270 and listener Albert 220 in parallel and without disturbing the other persons present in the room 200.

In another example, all of the people in room 200 may have the same appointment at 3:00 pm scheduled on their calendar applications. Additional invitees to the 3:00 pm appointment may not be present in the room 200. In this example the notification program 26 may broadcast, either directionally or non-directionally, an audio reminder of the 3:00 pm appointment to all of the people in room 200. After broadcasting the reminder and using data from the facial recognition program 74, the notification program 26 may record that all of the users in the room 200 have received the audio reminder of the appointment. Advantageously, in this manner the notification program 26 may track which invitees have received an audio reminder, and thereby avoid sending duplicate reminders to invitees who have already received a reminder.

In some examples and as a condition of recording that a listener received the audio notification, the notification program 26 may also determine whether a particular intended recipient of an audio reminder is within a minimum listening distance of a speaker that enables the recipient to hear the reminder. In one example, a minimum listening distance may be 6 meters from a speaker of the wall-mounted display 230, such as speaker 246, whether the speaker is a directional, non-directional, or dual-mode speaker.

Using depth image data 56, the notification program 26 may determine that all of the people in room 200 are within 6 meters of the speaker 246. Accordingly, the notification program 26 may determine that an audio reminder broadcast by speaker 246 is received by all of the people in room 200. The notification program 26 may then record that each of the people received the audio reminder. In other examples where one or more intended recipients are located at a distance greater than 6 meters from the speaker 246, the notification program 26 may determine that an audio reminder broadcast by speaker 246 is not received by such intended recipients. Accordingly, the notification program 26 may record that such intended recipients have not receive the audio reminder. It will be appreciated that the example minimum listening distance of 6 meters is merely exemplary, and that any suitable distance may be determined or selected and may be based on a variety of factors including, but not limited to, speaker characteristics, ambient noise level, hearing ability of a recipient, etc.

In other examples, the audio notification conditions 76 may include one or more privacy classifications 80 for an audio notification 14. Example privacy classifications may include, but are not limited to, a public classification denoting audio notifications suitable for non-directional, public broadcasting; a private-if-possible classification denoting audio notifications that are to be directionally broadcast solely to the intended recipient if possible in the current context or environment; a private-with-modified-notification classification denoting audio notifications having content that is to be modified when directional broadcast solely to the intended recipient is not possible, and a private classification denoting audio notifications that are to be directionally broadcast solely to the listener.

In one example, the notification program 26 of set-top box 254 may receive an audio notification 14 for listener Edward 284 that includes a private-if-possible privacy classification 80. For example, the audio notification 14 may relate to a company earnings news release that has a limited number of recipients. The notification program 26 may determine that broadcasting this notification privately and solely to listener Edward 284 is not possible. For example, because of the relative locations of the wall-mounted display 230 and Edward 284, Albert 220 and Darla 280, the dual-mode speaker system 20 of the wall-mounted display 230 may be incapable of directionally broadcasting the notification in a manner that enables solely listener Edward to hear the notification. Accordingly, and based on the private-if-possible privacy classification 80, in one example the notification program 26 may not broadcast the audio notification 14.

In another example, the notification program 26 of set-top box 254 may receive another audio notification 14 for listener Edward 284 that includes a private-with-modified-notification privacy classification 80. For example, the audio notification 14 may be the vocalized contents of a confidential voicemail left for listener Edward 284 from his family doctor regarding his wife's pregnancy test results. As in the previous example, the notification program 26 may determine that broadcasting this voicemail privately and solely to listener Edward 284 is not possible.

In this example, based on the private-with-modified-notification classification and on determining that delivery of the voicemail to listener Edward 284 using the directional broadcast mode 22 is not available, the notification program 26 may modify the content of the voicemail and broadcast the modified content using the non-directional broadcast mode 24. For example, based on determining that the voicemail is from Edward's family doctor, the notification program 26 may replace the content of the voicemail with a generic message, "Voicemail for Edward from your doctor." The notification program 26 may then broadcast this generic message to Edward 284 and others in the room 200 using the non-directional broadcast mode 24.

In other examples, the notification program 26 may select the directional broadcast mode 22 or the non-directional broadcast mode 24 by utilizing facial recognition data from a facial recognition program 74 to identify one or more persons in the room 200. For example, the notification program 26 may receive a company-wide email that includes all of the people in room 200 as recipients. The email may include a private privacy classification 80 that calls for the email to be delivered solely to the recipients of the email. Using facial recognition data from facial recognition program 74, the notification program 26 may identify each person in the room 200 and determine that each person is a recipient of the email. Because each person in the room 200 is a recipient of the email, the notification program may broadcast the vocalized content of the email in the non-directional broadcast mode 24 such that all persons in the room can hear the email.

In another example involving a private classification company-wide email that includes all of the people in room 200 except listener Charlie 278 as recipients, the notification program may identify listener Charlie 278 as an outside contractor who is not a recipient of the email. Accordingly, and based on the private classification, in this example the notification program 26 may refrain from broadcasting the vocalized content of the email in the non-directional broadcast mode 24. In some examples, the notification program 26 may broadcast the email in the directional broadcast mode 22 to each of the other four persons in the room who are recipients of the email.

In other examples, the audio notification conditions 76 may comprise a location of the computing device 10 and/or the dual-mode speaker system 20. For example, listener Albert 220 may take his mobile phone 216 with him into a movie theatre, library, symphony concert hall, or other environment in which extraneous noise is typically discouraged. Accordingly, based on the location of the mobile phone 216 in one of these locations, the notification program 26 of the phone may programmatically broadcast audio notifications 14 via directional speaker 218 solely in the directional broadcast mode 22.

In other examples and as noted above, computing device 10 and dual-mode speaker system 20 may be embodied in a wearable device, such as watch 298 worn by listener Charlie 278. It will be appreciated that computing device 10 and dual-mode speaker system 20 may be embodied in various other types or form factors of wearable devices, such as bracelets, necklaces, anklets, rings, etc.

Figure 3A:
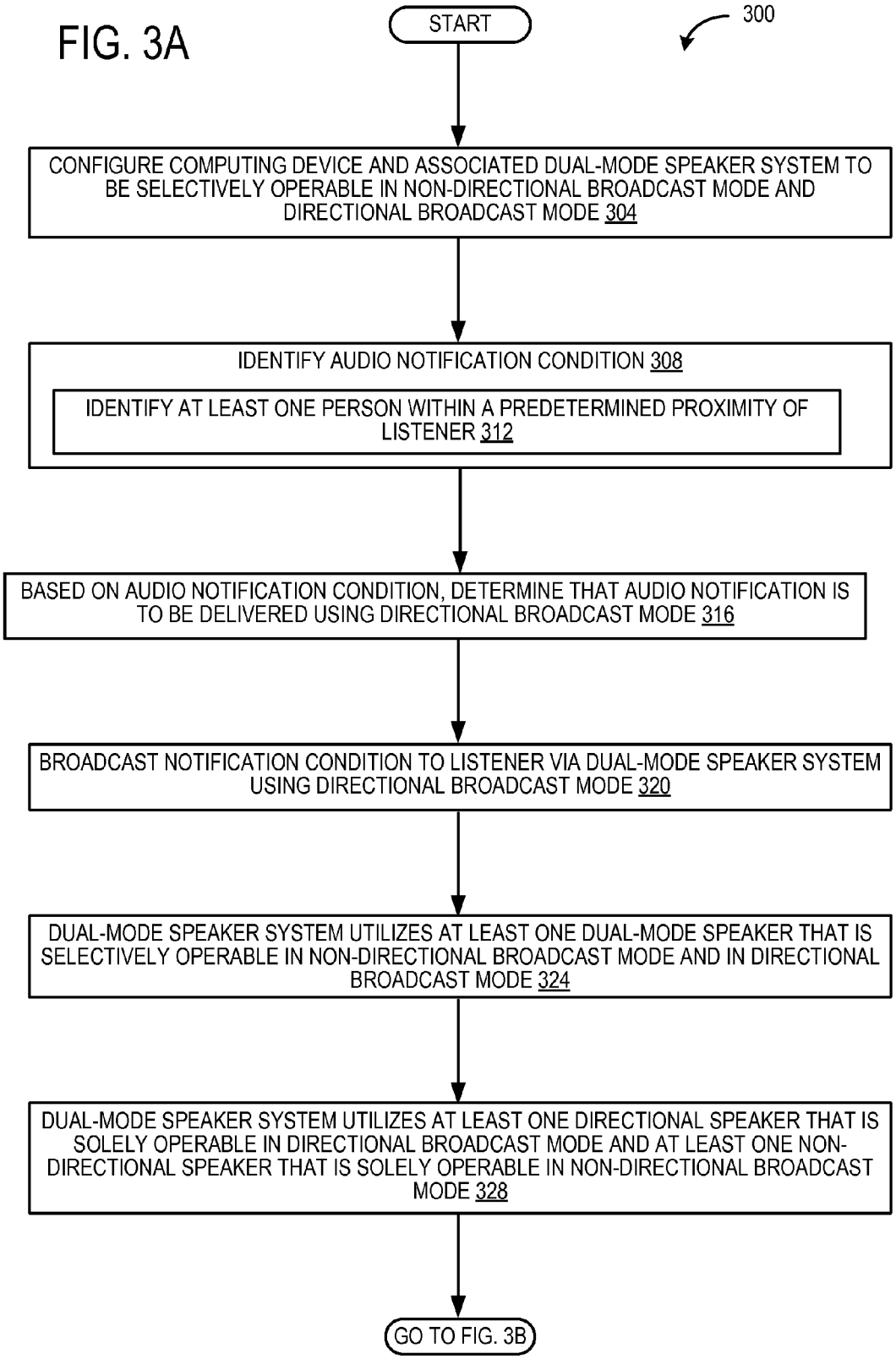
FIGS. 3A and 3B are a flow chart of a method for providing an audio notification according to an embodiment of the present disclosure.
Figure 3B:
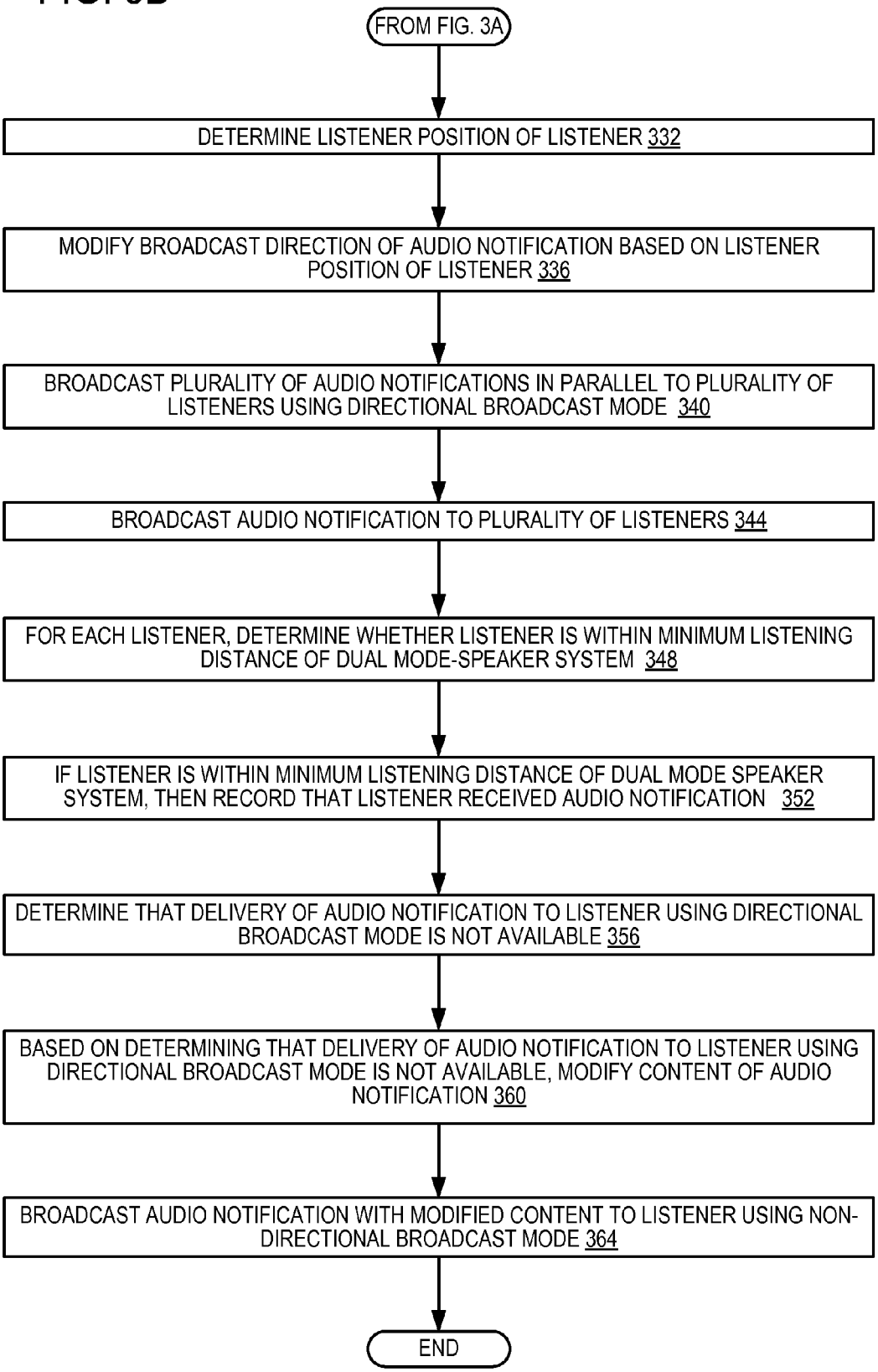

FIGS. 3A and 3B show a method 300 for providing an audio notification to a listener via a dual-mode speaker system according to an example of the present disclosure. The following description of method 300 is provided with reference to the software and hardware components of the computing device 10 and dual-mode speaker system 20 described above and shown in FIGS. 1-2. It will be appreciated that method 300 may also be performed in a variety of other contexts and using other suitable hardware and software components. For example, method 300 may be utilized in occupant notification systems in cars, buses, trains, aircraft, boats, and other transportation systems.

At 304, the method 300 may include configuring the computing device and associated dual-mode speaker system to be selectively operable in a non-directional broadcast mode and in a directional broadcast mode. At 308 the method 300 may include identifying an audio notification condition. At 312 identifying the audio notification condition may include identifying a presence of at least one person within a predetermined proximity of the listener.

At 316 the method 300 may include, based on the audio notification condition, determining that the audio notification is to be delivered using the directional broadcast mode. At 320 the method 300 may include broadcasting the audio notification to the listener via the dual-mode speaker system using the directional broadcast mode. At 324 the dual-mode speaker system may utilize at least one dual-mode speaker that is selectively operable in the non-directional broadcast mode and in the directional broadcast mode.

At 328 the dual-mode speaker system may utilize at least one directional speaker that is solely operable in the directional broadcast mode and at least one non-directional speaker that is solely operable in the non-directional broadcast mode. With reference now to FIG. 3B, at 332 the method 300 may include determining a listener position of the listener. At 336 the method 300 may include modifying a broadcast direction of the audio notification based on the listener position of the listener. At 340 the method 300 may include broadcasting a plurality of audio notifications in parallel to a plurality of listeners using the directional broadcast mode.

At 344 the method 300 may include broadcasting an audio notification to a plurality of listeners. At 348 the method 300 may include, for each listener of the plurality of listeners, determining whether the listener is within a minimum listening distance of the dual-mode speaker system. At 352 the method 300 may include, if the listener is within the minimum listening distance of the dual-mode speaker system, then recording that the listener received the audio notification.

At 356 the method 300 may include determining that delivery of the audio notification to the listener using the directional broadcast mode is not available. At 360 and based on determining that delivery of the audio notification to the listener using the directional broadcast mode is not available, the method 300 may include modifying content of the audio notification. At 364 the method 300 may include broadcasting the audio notification with the modified content to the listener using the non-directional broadcast mode.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

Figure 4:
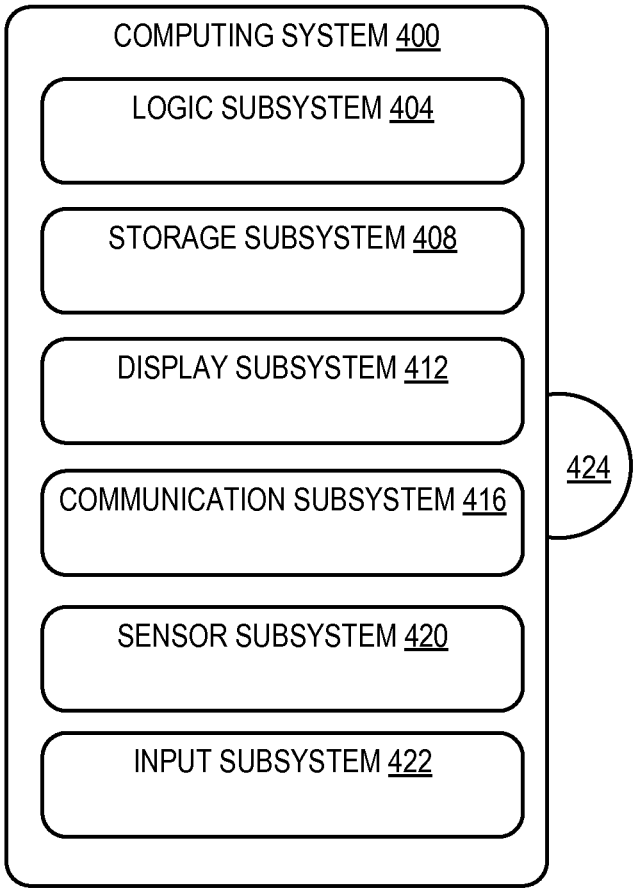
FIG. 4 shows a simplified schematic illustration of computing system.

FIG. 4 schematically shows a nonlimiting embodiment of a computing system 400 that may perform one or more of the above described methods and processes. Computing device 10 may take the form of computing system 400. Computing system 400 is shown in simplified form. It is to be understood that virtually any computer architecture may be used without departing from the scope of this disclosure. In different embodiments, computing system 400 may take the form of a mainframe computer, server computer, desktop computer, laptop computer, tablet computer, home entertainment computer, network computing device, mobile computing device, mobile communication device, gaming device, etc.

As shown in FIG. 4, computing system 400 includes a logic subsystem 404 and a storage subsystem 408. Computing system 400 may optionally include a display subsystem 412, a communication subsystem 416, a sensor subsystem 420, an input subsystem 422 and/or other subsystems and components not shown in FIG. 4. Computing system 400 may also include computer readable media, with the computer readable media including computer readable storage media and computer readable communication media. Computing system 400 may also optionally include other user input devices such as keyboards, mice, game controllers, and/or touch screens, for example. Further, in some embodiments the methods and processes described herein may be implemented as a computer application, computer service, computer API, computer library, and/or other computer program product in a computing system that includes one or more computers.

Logic subsystem 404 may include one or more physical devices configured to execute one or more instructions. For example, the logic subsystem 404 may be configured to execute one or more instructions that are part of one or more applications, services, programs, routines, libraries, objects, components, data structures, or other logical constructs. Such instructions may be implemented to perform a task, implement a data type, transform the state of one or more devices, or otherwise arrive at a desired result.

The logic subsystem 404 may include one or more processors that are configured to execute software instructions. Additionally or alternatively, the logic subsystem may include one or more hardware or firmware logic machines configured to execute hardware or firmware instructions. Processors of the logic subsystem may be single core or multicore, and the programs executed thereon may be configured for parallel or distributed processing. The logic subsystem may optionally include individual components that are distributed throughout two or more devices, which may be remotely located and/or configured for coordinated processing. One or more aspects of the logic subsystem may be virtualized and executed by remotely accessible networked computing devices configured in a cloud computing configuration.

Storage subsystem 408 may include one or more physical, persistent devices configured to hold data and/or instructions executable by the logic subsystem 404 to implement the herein described methods and processes. When such methods and processes are implemented, the state of storage subsystem 408 may be transformed (e.g., to hold different data).

Storage subsystem 408 may include removable media and/or built-in devices. Storage subsystem 408 may include optical memory devices (e.g., CD, DVD, HD-DVD, Blu-Ray Disc, etc.), semiconductor memory devices (e.g., RAM, EPROM, EEPROM, etc.) and/or magnetic memory devices (e.g., hard disk drive, floppy disk drive, tape drive, MRAM, etc.), among others. Storage subsystem 408 may include devices with one or more of the following characteristics: volatile, nonvolatile, dynamic, static, read/write, read-only, random access, sequential access, location addressable, file addressable, and content addressable.

In some embodiments, aspects of logic subsystem 404 and storage subsystem 408 may be integrated into one or more common devices through which the functionally described herein may be enacted, at least in part. Such hardware-logic components may include field-programmable gate arrays (FPGAs), program- and application-specific integrated circuits (PASIC/ASICs), program- and application-specific standard products (PSSP/ASSPs), system-on-a-chip (SOC) systems, and complex programmable logic devices (CPLDs), for example.

FIG. 4 also shows an aspect of the storage subsystem 408 in the form of removable computer readable storage media 424, which may be used to store data and/or instructions executable to implement the methods and processes described herein. Removable computer-readable storage media 424 may take the form of CDs, DVDs, HD-DVDs, Blu-Ray Discs, EEPROMs, and/or floppy disks, among others.

It is to be appreciated that storage subsystem 408 includes one or more physical, persistent devices. In contrast, in some embodiments aspects of the instructions described herein may be propagated in a transitory fashion by a pure signal (e.g., an electromagnetic signal, an optical signal, etc.) that is not held by a physical device for at least a finite duration. Furthermore, data and/or other forms of information pertaining to the present disclosure may be propagated by a pure signal via computer-readable communication media.

When included, display subsystem 412 may be used to present a visual representation of data held by storage subsystem 408. As the above described methods and processes change the data held by the storage subsystem 408, and thus transform the state of the storage subsystem, the state of the display subsystem 412 may likewise be transformed to visually represent changes in the underlying data. The display subsystem 412 may include one or more display devices utilizing virtually any type of technology. Such display devices may be combined with logic subsystem 404 and/or storage subsystem 408 in a shared enclosure, or such display devices may be peripheral display devices.

When included, communication subsystem 416 may be configured to communicatively couple computing system 400 with one or more networks and/or one or more other computing devices. Communication subsystem 416 may include wired and/or wireless communication devices compatible with one or more different communication protocols. As nonlimiting examples, the communication subsystem 416 may be configured for communication via a wireless telephone network, a wireless local area network, a wired local area network, a wireless wide area network, a wired wide area network, etc. In some embodiments, the communication subsystem may allow computing system 400 to send and/or receive messages to and/or from other devices via a network such as the Internet.

When included, sensor subsystem 420 may include one or more sensors configured to sense different physical phenomenon (e.g., visible light, infrared light, sound, acceleration, orientation, position, etc.) as described above. Sensor subsystem 420 may be configured to provide sensor data to logic subsystem 404, for example. Such data may include depth information, eye-tracking information, image information, audio information, ambient lighting information, position information, motion information, user location information, and/or any other suitable sensor data that may be used to perform the methods and processes described above.

When included, input subsystem 422 may comprise or interface with one or more sensors or user-input devices such as a game controller, gesture input detection device, voice recognizer, inertial measurement unit, keyboard, mouse, or touch screen. In some embodiments, the input subsystem 422 may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity.

The term "program" may be used to describe an aspect of the computing device 10 that is implemented to perform one or more particular functions. In some cases, such a program may be instantiated via logic subsystem 404 executing instructions held by storage subsystem 408. It is to be understood that different programs may be instantiated from the same application, service, code block, object, library, routine, API, function, etc. Likewise, the same program may be instantiated by different applications, services, code blocks, objects, routines, APIs, functions, etc. The term "program" is meant to encompass individual or groups of executable files, data files, libraries, drivers, scripts, database records, etc.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A method for providing an audio notification to a listener via a dual-mode speaker system of a computing device, wherein the computing device and associated dual-mode speaker system are selectively operable in a non-directional broadcast mode and in a directional broadcast mode, the method comprising:

identifying an audio notification condition;

based at least in part on the audio notification condition, determining that the audio notification is to be delivered using the directional broadcast mode; and broadcasting the audio notification to the listener via the dual-mode speaker system using the directional broadcast mode.

2. The method of claim 1, wherein the dual-mode speaker system utilizes at least one dual-mode speaker that is selectively operable in the non-directional broadcast mode and in the directional broadcast mode.

3. The method of claim 1, wherein the dual-mode speaker system utilizes at least one directional speaker that is solely operable in the directional broadcast mode and at least one non-directional speaker that is solely operable in the non-directional broadcast mode.

4. The method of claim 1, further comprising determining a listener position of the listener.

5. The method of claim 4, further comprising modifying a broadcast direction of the audio notification based on the listener position of the listener.

6. The method of claim 1, further comprising broadcasting a plurality of different audio notifications in parallel to a plurality of listeners using the directional broadcast mode.

7. The method of claim 1, wherein identifying an audio notification condition comprises identifying a presence of at least one person within a predetermined proximity of the listener.

8. The method of claim 1, further comprising:

broadcasting the audio notification to a plurality of listeners; and for each listener of the plurality of listeners:

determining whether the listener is within a minimum listening distance of the dual-mode speaker system; and if the listener is within the minimum listening distance of the dual-mode speaker system, then recording that the listener received the audio notification.

9. The method of claim 1, further comprising:

determining that delivery of the audio notification to the listener using the directional broadcast mode is not available;

based on determining that delivery of the audio notification to the listener using the directional broadcast mode is not available, modifying content of the audio notification; and broadcasting the audio notification with the modified content to the listener using the non-directional broadcast mode.

10. A computing device for providing an audio notification to a listener, the computing device comprising:

a dual-mode speaker system selectively operable in a non-directional broadcast mode and in a directional broadcast mode; and a notification program executed by a processor of the computing device, the notification program comprising the non-directional broadcast mode and the directional broadcast mode, the notification program configured to:

identify an audio notification condition;

based at least in part on the audio notification condition, determine that the audio notification is to be delivered using the directional broadcast mode; and broadcast the audio notification to the listener via the dual-mode speaker system using the directional broadcast mode.

11. The computing device of claim 10, wherein the dual-mode speaker system utilizes at least one dual-mode speaker that is selectively operable in the non-directional broadcast mode and in the directional broadcast mode.

12. The computing device of claim 11, wherein the at least one dual-mode speaker is configured to broadcast to a fixed location in the directional broadcast mode.

13. The computing device of claim 10, wherein the dual-mode speaker system utilizes a plurality of directional speakers that are solely operable in the directional broadcast mode, and the notification program is further configured to broadcast a plurality of audio notifications to a plurality of listeners in parallel via the plurality of directional speakers using the directional broadcast mode.

14. The computing device of claim 10, wherein the dual-mode speaker system utilizes at least one directional speaker that is solely operable in the directional broadcast mode and at least one non-directional speaker that is solely operable in the non-directional broadcast mode.

15. The computing device of claim 14, wherein the notification program is further configured to determine a listener position of the listener, and the at least one directional speaker is configured to modify a broadcast direction of the audio notification based on the position of the listener.

16. The computing device of claim 15, wherein the at least one directional speaker is a first directional speaker, the broadcast direction is a first broadcast direction, and the audio notification is a first audio notification, the dual-mode speaker system further comprising a second directional speaker that is configured to modify a second broadcast direction of a second audio notification based on a position of a person who is not the listener.

17. The computing device of claim 10, wherein identifying an audio notification condition comprises identifying a presence of at least one person within a predetermined proximity of the listener.

18. The computing device of claim 10, wherein the audio notification condition comprises a privacy classification of the audio notification, and the privacy classification is selected from the group consisting of a private classification, private-if-possible classification, private-with-modified-notification classification, and public classification.

19. The method of claim 18, wherein the privacy classification comprises the private-with-modified-notification classification, and the notification program is further configured to:

determine that delivery of the audio notification to the listener using the directional broadcast mode is not available;

based on determining that delivery of the audio notification to the listener using the directional broadcast mode is not available, modify content of the audio notification; and broadcast the audio notification with the modified content to the listener using the non-directional broadcast mode.

20. A method for providing an audio notification to a listener via a dual-mode speaker system of a computing device, wherein the computing device and associated dual-mode speaker system are selectively operable in a non-directional broadcast mode and in a directional broadcast mode, the method comprising:

identifying a private classification of the audio notification;

based on the private classification, determining that the audio notification is to be delivered using the directional broadcast mode;

determining that delivery of the audio notification to the listener using the directional broadcast mode is not available;

based on determining that delivery of the audio notification to the listener using the directional broadcast mode is not available, modifying content of the audio notification; and broadcasting the audio notification with the modified content to the listener via the dual-mode speaker system using the non-directional broadcast mode.

21. The method of claim 1, further comprising using depth image data to select the listener to whom the audio notification is broadcasted.

22. The computing device of claim 10, wherein the notification program is further configured to use depth image data to select the listener to whom the audio notification is broadcasted.

23. The method of claim 20, further comprising using depth image data to select the listener to whom the audio notification is broadcasted.

* * * * *